United States Patent [19]

Gueret

[11] Patent Number: 4,500,939

[45] Date of Patent: Feb. 19, 1985

[54] HAIR BRUSH WITH A FLEXIBLE BASE PLATE MADE OF A PLASTIC MATERIAL

[75] Inventor: Jean-Louis H. Gueret, Paris, France

[73] Assignee: L'Oreal, Paris, France

[21] Appl. No.: 476,718

[22] Filed: Mar. 18, 1983

[30] Foreign Application Priority Data

Apr. 7, 1982 [FR] France ..... 82 06072

[51] Int. Cl.[3] ..... H05F 3/00; A46B 9/08

[52] U.S. Cl. ..... 361/221; 15/159 A; 15/187; 15/194; 361/212; 361/220

[58] Field of Search ..... 361/212, 220, 221; D4/14, 99; 132/9, 11 R, 120; 15/159 R, 159 A, 187, 190, 194

[56] References Cited

U.S. PATENT DOCUMENTS

| | | | |
|---|---|---|---|
| 2,645,804 | 7/1953 | Gantz et al. | 15/187 |
| 2,889,567 | 6/1959 | Solomon | 15/187 X |
| 2,920,334 | 1/1960 | Keller | 15/187 |
| 3,095,523 | 6/1963 | Stith | 361/220 |
| 3,755,847 | 9/1973 | Liebscher | 15/187 X |
| 4,030,158 | 6/1977 | Blair et al. | 15/159 A |

FOREIGN PATENT DOCUMENTS

| | | | |
|---|---|---|---|
| 2726718 | 12/1978 | Fed. Rep. of Germany | 15/159 R |
| 2460198 | 2/1981 | France | 15/159 A |
| 2054368 | 2/1981 | United Kingdom | 15/159 A |

*Primary Examiner*—Harry E. Moose, Jr.

*Attorney, Agent, or Firm*—Cushman, Darby & Cushman

[57] ABSTRACT

A hair brush of antistatic plastic material comprises an apertured base plate in the form of a grid having bristles integrally moulded therewith. The base plate is convexly curved in the finished brush with the bristles on the convex side and the grid construction imparts to the brush sufficient resilience to allow the relatively stiff integrally moulded bristles to execute a comfortable brushing action.

20 Claims, 18 Drawing Figures

HAIR BRUSH WITH A FLEXIBLE BASE PLATE MADE OF A PLASTIC MATERIAL

DESCRIPTION

The present invention concerns an anti-static hair brush comprising at least one flexible base plate made of a rigid plastic.

To make brushes with a sufficiently flexible base plate to be fixed on various frames or fittings so as to present a fan-shaped bristle structure, one has, until now, been obliged to attach these bristles to the base plate, for instance by welding the bristles on the flat plate, whereupon the assembly of the plate was effected on the appropriate shaped mounting so that the bristles made, for instance, of nylon and welded to the base plate made, for instance, of rubber diverge from each other so as to obtain an external fan shape or hedge-hog type structure which is favourable for brushing. According to another method for manufacturing brushes, an integrally moulded flat member was obtained, comprising a single base plate and bristles. In fact, in this latter case, it was necessary to use a sufficiently rigid plastic to endow the bristles with the resistance and elasticity necessary for good brushing, giving rise to a base plate which did not have the deformation characteristics suitable to all the mountings. Moreover, it was not possible to use any elastomer material since the hairs catch on the bristles.

The aim of the invention is to obviate these manufacturing drawbacks of the previous method by providing a new type of hair brush having a sufficiently flexible base plate to be obtained by moulding together with the brushing bristles.

The present invention therefore provides an antistatic hair brush comprising a handle and at least one brush element carried thereby, the said brush element comprising a flexible base plate made of an antistatic plastic material and provided with holes to define a grid forming a supporting structure for the bristles which are integrally moulded together with the base plate and are disposed perpendicular to the said plate.

In a preferred embodiment of the base plate, this grid forming the supporting structure is constituted by a multiplicity of diverging radial ribs, most of which are supported on, on the one hand, a central oval-shaped element and, on the other hand, the outer oval-shaped peripheral edge of the base plate, these ribs being arranged in an intersecting relationship with further oval-shaped elements situated in the same plane as the ribs regularly interspaced from each other and disposed substantially concentrically in relation to each other and in relation to the central oval-shaped element and to the outer peripheral edge of the base plate; each bristle is situated in a zone defined between the intersections of two adjacent radial ribs with a said oval-shaped element; each bristle is situated equidistant from the intersections of two adjacent ribs with a said oval-shaped supporting element; the grid forming the base plate is constituted by ribs intersecting at right angles so as to define zones between two adjacent ribs over which the brush bristles are distributed in a regular manner; each bristle is situated equidistant between the intersections of two adjacent ribs with a third rib; the base plate is made of polyamide 12, or of 'Rilsan' (a Registered Trade Mark for nylon 11), or of Rilsan grafted to a block copolymer of polyether and polyamide; the plastic material forming the base plate and the bristles contains at least one antistatic carbon constituent. As an antistatic carbon constituent, there may advantageously be used those described in French Patent Publication No. 2,460,198.

In a first embodiment of the brush according to the invention, the brush handle and its base plate may be obtained integrally by moulding.

In accordance with a second embodiment, the base plate constitutes a component which is distinct from the supporting handle, the said base plate being moulded flat.

According to a third embodiment of the brush of the invention, the supporting handle is provided with an opening having on its inner side surface a peripheral groove having a dovetail cross section to receive the edge of the base plate by catch engagement, the said base plate assuming a convex shape on the side on which the bristles are arranged.

According to a fourth embodiment of the brush according to the invention, the brush handle comprises a recess whose floor comprises a plurality of oblong or circular through holes, the recess having on its inner side surface a groove having a dovetail cross section to receive the base plate by catch engagement, whereby the base plate assumes a convex shape on the side whereon the bristles are distributed.

A first variant of the base plate has a rectangular shape and is rolled up cylindrically and welded on its two opposite edges to form a bristled cylindrical base element.

In a first embodiment of the brush using this first variant of the base plate, the bristled cylindrical base element is fitted on a cylindrical support.

In a second embodiment using this first variant of the base plate, the bristled cylindrical base element is fixed to its associated supporting handle by being held between the brush hand grip and a cap, the hand grip and the cap forming two elements of the same supporting handle and being each disposed near one of the ends of the bristled cylindrical base element.

In a third embodiment of the brush using this first variant of the base plate, the brush handle is extended axially by a rod having at its free end a catch engagement stud intended to cooperate with a corresponding recess provided in the cap.

A second variant of the base plate is formed by a rectangular base plate provided on two of its opposite edges with a fastening structure formed by a strip flexible in its connecting zone with the rest of the base plate, the said strip having a longitudinal rib on its free edge.

In a first embodiment of the brush using this second variant of the base plate, the brush handle is extended axially by a contoured element with a substantially crescent-shaped cross-section comprising a longitudinal axial groove to receive the correspondingly shaped lower end of the axial flange of a slidable holding element of a substantially T-shaped cross section, the top part of the T constituting a cap which surmounts the contoured element, the slidable holding element and the contoured element defining between them recesses to hold the longitudinal ribs of the base plate.

In a second embodiment of the brush using this second variant of the base plate, the brush handle is extended axially by a contoured element with a crescent-shaped cross-section having a central axially extending flange whose upper edge is formed as a rib; said flange being disposed between two grooves of said contoured element of the handle, said contoured elements of the hanndle accommodating a slidable holding component having axially a shape constituted by two longitudinal side flanges thickened on their free edges to define a shape corresponding to the flange and to the two grooves of the contoured element of the handle so as to be capable of slide engagement thereon, said slidable holding element comprising two side flanges which, by cooperating with the contoured element of the handle, hold the base plate by its longitudinal ribs.

The slidable holding element has, at its end, near the brush handle, a projection adapted to engage in a recess in the handle.

In these various embodiments proceeding from the above defined three variants of the base plate, the brush of the invention has a certain number of improved characteristics, especially as regards resistance to wear and to chemical action, imparted to it by the rigid plastics materials used for its manufacture, these characteristics being superior to natural or synthetic elastomers which are normally used. By reason of the perforated structure of its base plate, this brush has excellent elasticity, is more easily cleaned and can be very rapidly dried after being washed. Even if a blow dryer is used, the static charges set up by the blowing dissipate from their points of generation.

In order that the invention may more readily be understood, a number of embodiments, shown in the accompanying drawings will now be described, merely by way of illustrative but not restrictive examples. In these drawings.

Figure 1:
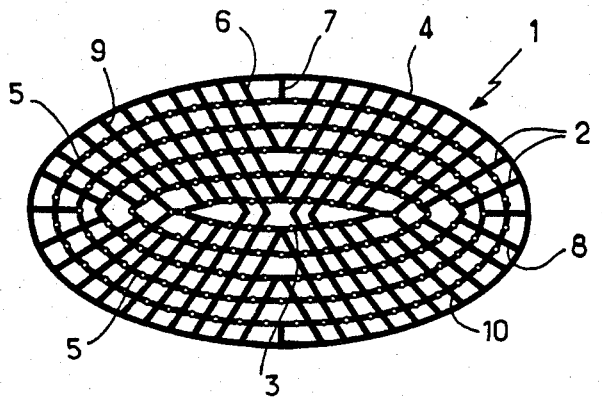
FIG. 1 is a top view of a first form of the base plate for a brush according to the invention.
Figure 2:
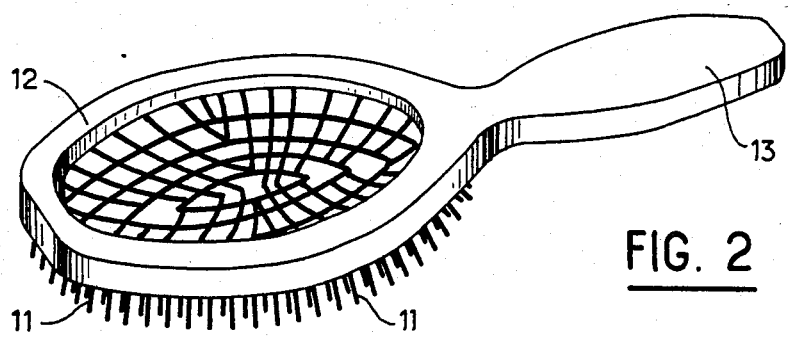
FIG. 2 is a view in perspective of a first embodiment of the brush according to the invention.
Figure 3:
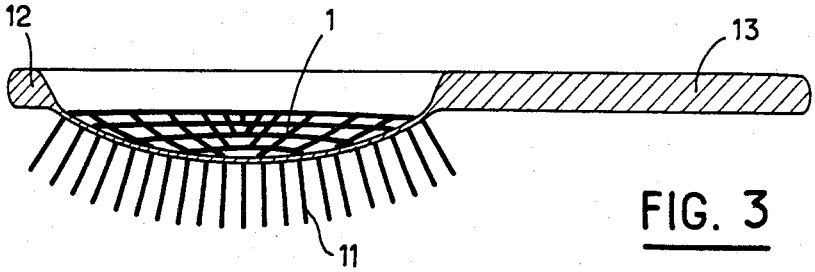
FIG. 3 is an axial longitudinal cross-sectional view of the brush of FIG. 2.

Referring now to the drawings, there will be seen an oval-shaped perforated base plate 1 for a brush according to the invention. This plate is formed by a plurality of ribs supported by and disposed between, on the one hand a central oval-shaped element 3 and, on the other hand, an edge 4 of the oval-shaped base plate 1. Between this central element 3 and edge 4, there are disposed, concentrically in the same plane as ribs 2 and in an intersecting relationship therewith, a plurality of oval-shaped elements 5 regularly interspaced from each other and disposed concentrically between the edge 4 and the central element 3. Some of the ribs 6, 7, 8, 9, 10, which are supported on edge 4 are shorter than the rest and do not reach the central element 3, this design having been conceived because of the oval-shaped design of base plate 1.

On one of the sides of this base plate 1, and perpendicular thereto, there are arranged a multiplicity of bristles 11 integrally moulded together with the base plate 1. These bristles 11 are advantageously situated in the zone defined by the intersection of two adjacent radial ribs with one of the oval-shaped elements, each bristle being situated equidistantly between the said intersections.

This net-like perforated structure endows the base plate 1 with such flexibility that it can be obtained jointly with a mounting or support 12 and a handle 13 by integral moulding.

Figure 4:
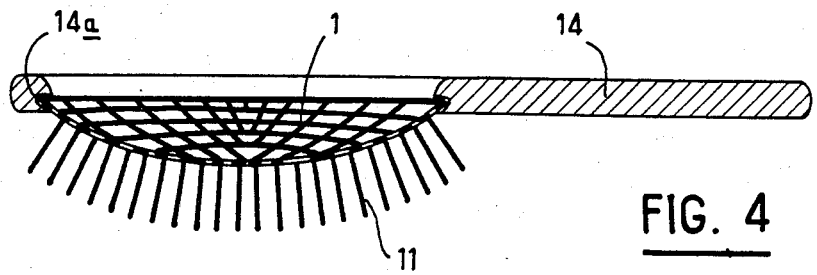
FIG. 4 is an axial longitudinal cross-sectional view of a second embodiment of the brush according to the invention, formed as two components.

In the embodiment of FIG. 4, made in two parts, the support or mounting zone of the brush handle 14 has an opening with, over the periphery thereof, a catch engagement groove 14*a* having a dovetail cross section. This groove is dimensioned so that after the base plate 1 has been introduced into it by catch engagement, the base plate assumes a convex shape on the side on which the bristles 11 are distributed.

Figure 5:
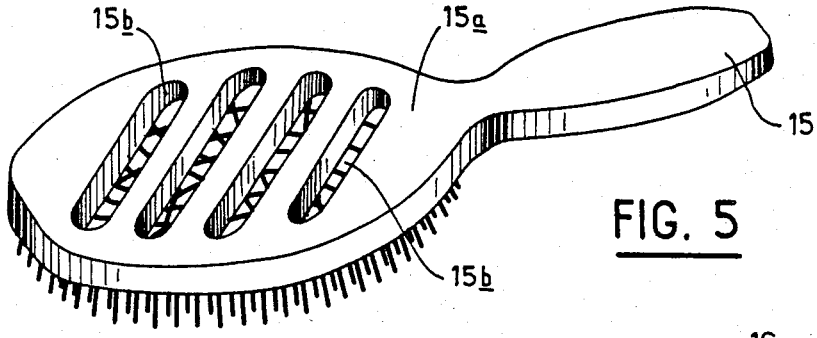
FIG. 5 is a perspective view of a third embodiment of the brush according to the invention.

In the embodiment of FIG. 5, the support zone 15*a* of handle 15 is provided with a plurality of oblong holes 15*b*; catch-engagement means (not shown) are also provided on the lower side of the support zone 15*a* for fixing the base plate 1 therein. This mode of embodiment is more particularly appropriate for use with a device for dispensing hair treatment products or with a blow dryer for the hair.

Figure 6:
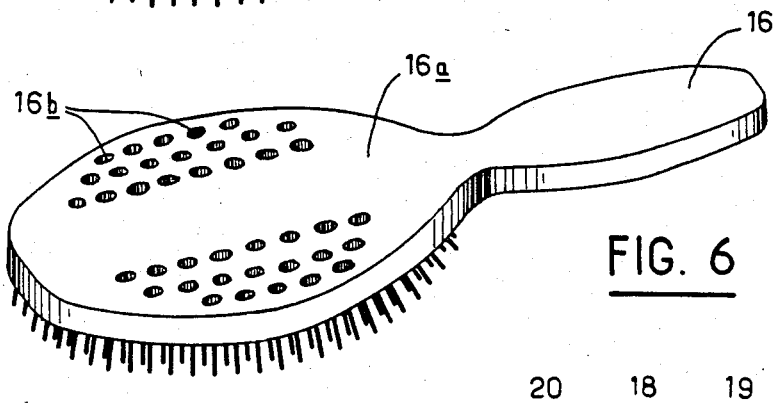
FIG. 6 is a perspective view of a fourth embodiment of the brush according to the invention.
Figure 7:
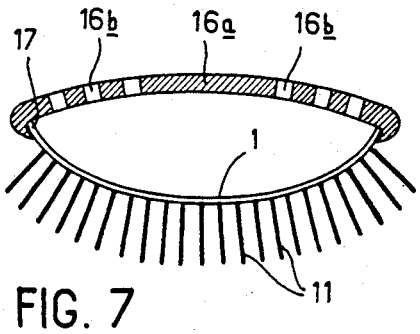
FIG. 7 is a view in a transverse cross-section of the embodiment of FIG. 6.

In the embodiment of FIG. 6, the support or mounting zone 16*a* of the handle 16, intended to support the base plate 1, is provided with a multiplicity of through holes 16*b* having the same function as the oblong holes 15*b* of the embodiment of FIG. 5. The lower side of the support zone 16*a* has a cut out around the periphery of which is a groove 17 having a dovetail cross section dimensioned so that, by catch engagement, the base plate 1 is capable of assuming a convex shape on its side carrying the bristles 11 so that the bristles may diverge from each other, thus presenting a distribution in space which is suitable for brushing.

Figure 8:
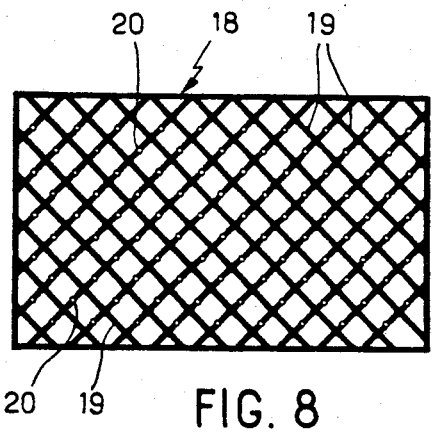
FIG. 8 is a top view of a variant of the base plate according to the invention.

In FIG. 8, there has been shown a top view of a variant of the base plate 1. This base plate 18 is constituted by ribs 19 intersecting each other at right angles and having, between the intersections of two adjacent ribs with another rib, bristles 20 which are perpendicular to the plane of the plate.

Figure 9:
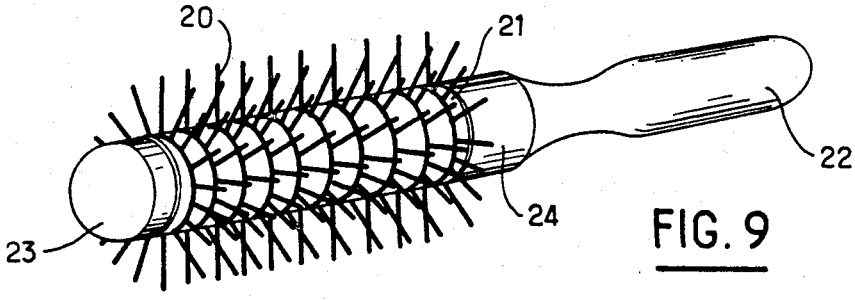
FIG. 9 is a perspective view of a first embodiment of the brush according to the invention using the plate variant of FIG. 8.

This base plate 18 advantageously has a rectangular shape so that it may be rolled up and welded by two of its edges onto a cylindrical fitting 24 so as to form a cylindrical support element 21. On this cylindrical support element 21, the bristles 20 are radial and diverge from each other thereby facilitating brushing. This cylindrical support element 21 may have a brush handle 22 connected to and fixed at one of its ends while the other end is provided with a cap 23 (see FIG. 9).

Figure 10:
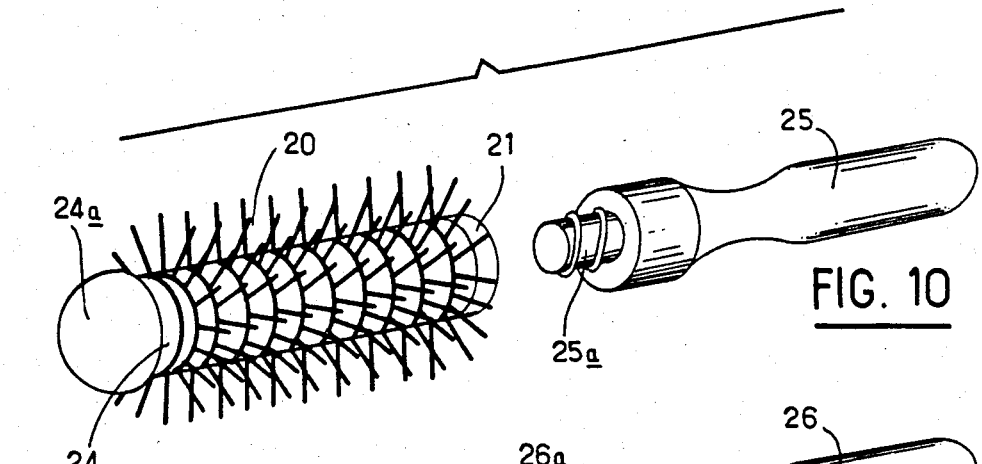
FIG. 10 is a perspective view of a second embodiment of the brush according to the invention, using the base plate of FIG. 8.

In the embodiment of FIG. 10, the cylindrical support element 21 is fitted on a fitting 24 having at one of its ends a cap 24*a* whilst its other hand is tapped so as to accommodate the threaded end fitting 25*a* of an elongate round handle 25.

Figure 11:
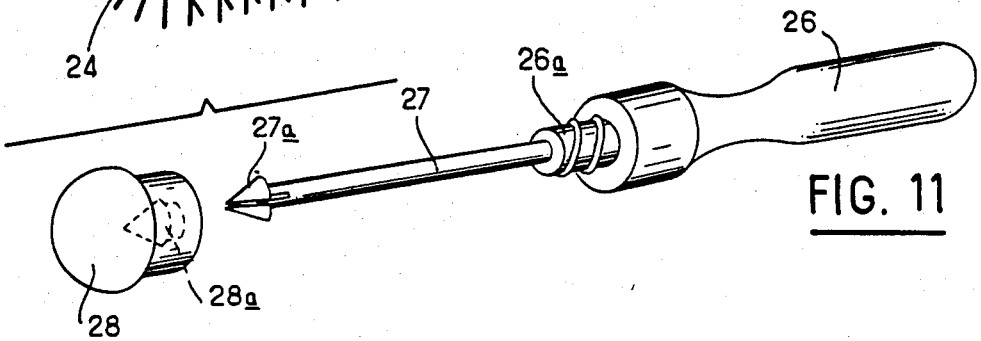
FIG. 11 is a perspective view of a third embodiment of the brush according to the invention using the base plate variant of FIG. 8.

In the embodiment of FIG. 11, handle 26 is also provided with a threaded end fitting 26*a* and extends axially from this end fitting 26*a* via a rod 27 provided at its free end with a conical snap-fitting stud 27*a* slit axially and intended to catch engage in a recess 28*a* of corresponding shape in a cap 28. This arrangement is more particularly suited to hollow support elements of a flexible type; for greater flexibility, the support element may also be dispensed with, the base plate 18 being maintained in a cylindrical roll without any other support except that of the ends.

Figure 12:
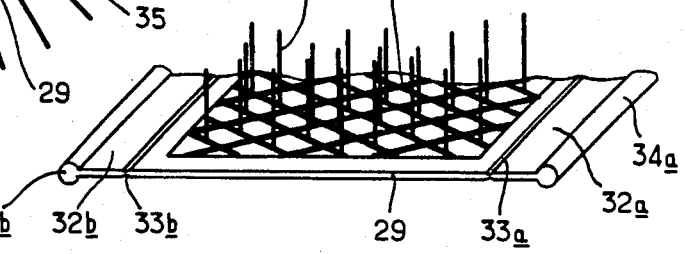
FIG. 12 is a second variant of the embodiment of the base plate for a brush according to the invention.

In the variant of FIG. 12, the base plate 29 has a net-like structure of the same type as the plate of FIG. 8 as regards the disposition of ribs 30 and of the bristles 31. Moreover, this base plate is extended on its two opposite edges by side strips 32*a*, 32*b* which are connected to the base plate proper by way of a bending zone 33*a*, 33*b* and which have their free end edges 34*a*, 34*b* in the shape of thickened ribs.

Figure 13:
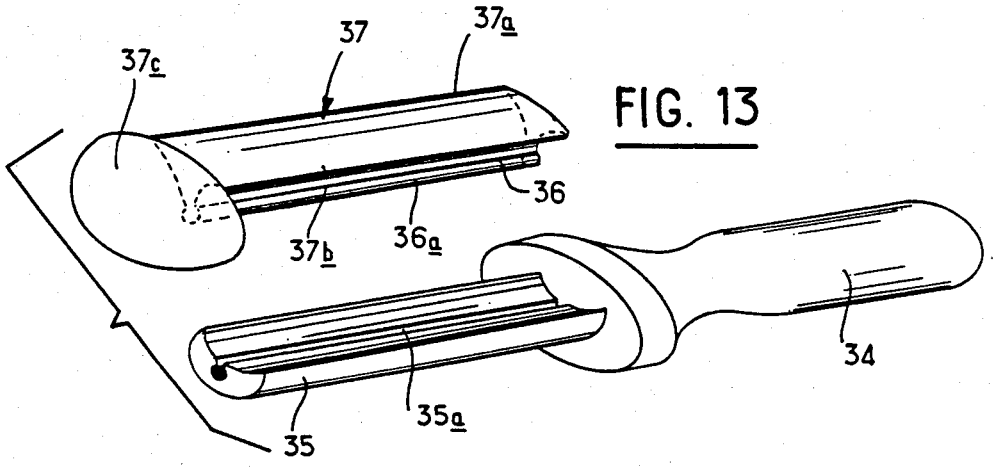
FIG. 13 is a perspective view of a first embodiment of the brush acccording to the invention using the base plate of FIG. 12.
Figure 14:
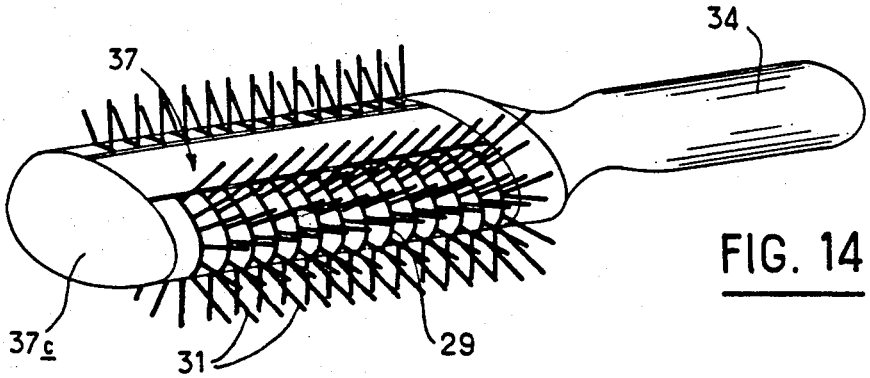
FIG. 14 is a perspective view of the brush obtained by assembling the elements of FIGS. 12 and 13.
Figure 15:
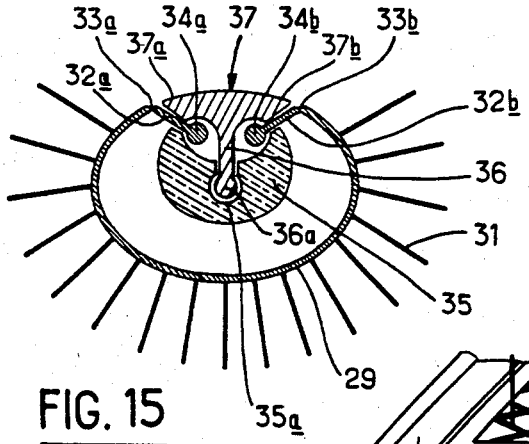
FIG. 15 is a transverse cross-sectional view of the brush of FIG. 14.
Figure 16:
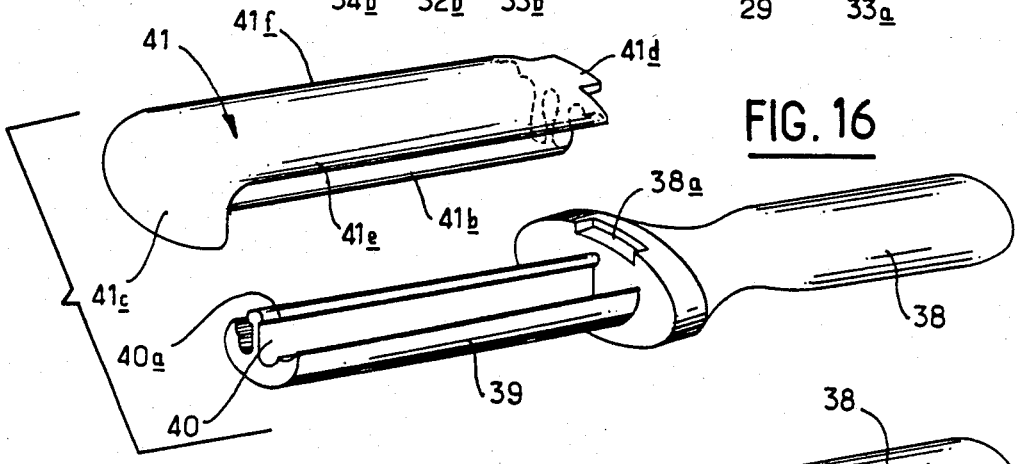
FIG. 16 is a perspective view of a second embodiment of the brush according to the invention, using the base plate of FIG. 12.

This type of plate 29 is more especially intended to be mounted on brush handles formed as two components, as shown more precisely in FIGS. 13 and 16. In the embodiment of the brush shown in FIG. 13, the handle 34 is extended axially by a support element 35 in the form of a contoured rod having a substantially crescent-shaped cross section. This contoured rod has, on its concave shape, an axially extending groove 35*a* shaped to hold by slide insertion, the lower longitudinal rib 36*a* of the central flange 36 of a slidable holding component 37 having a substantially T-shaped cross-section. The two side strips 37*a*, 37*b* come by sliding to a position covering the concave face of the support element 35 so as to define two side housings on either side of the central flange 36 wherein there are held, with a given clearance, the end ribs 34*a*, 34*b* of side strips 32*a*, 32*b* of the base plate 29 of FIG. 12.

When the brush is assembled, the side strips 32*a*, 32*b* are bent through the required angle so that they can be held on the concave face of support element 35 whereupon the rib 36*a* of holding element 37 is introduced by sliding inside the groove 35*a* until the end cap 37*c* covers the free end of the support element 35. To endow the base plate 29, shaped into a brush element for a half-round brush, with transverse clearance for imparting flexibility to it, the cap 37*c* of the slidable holding element 37 should not abut against the said base plate 29.

Figure 17:
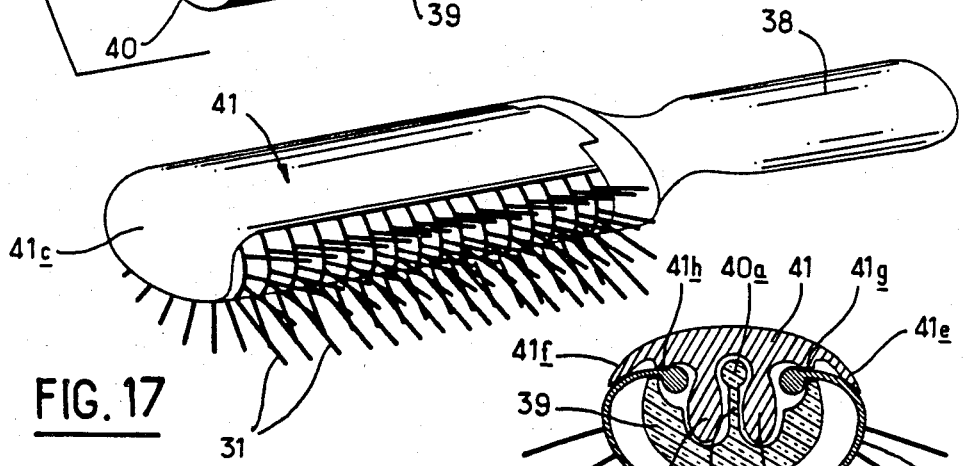
FIG. 17 is a perspective view of a brush according to the invention, obtained by assembling the brush elements shown in FIGS. 12 and 16.
Figure 18:
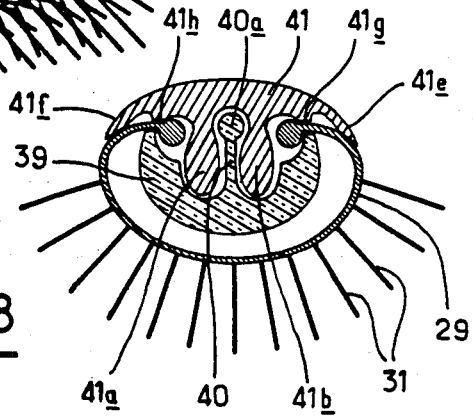
FIG. 18 is a transverse cross-section of the brush of FIG. 17.

In the embodiment of FIG. 17, the brush handle is also formed by two parts capable of being assembled by slide insertion. The first part is constituted by the handle 38 proper axially extended by a contoured support element 39 whose cross-section is substantially crescent-shaped. This contoured support element 39 is provided with an axially extending longitudinal flange on its concave side. This flange 40 has along its free edge a rib 40*a*. This rib 40*a* is intended to be slide-fitted in a longitudinal recess provided on the concave side of a contoured holding element 41 having a crescent-shaped cross-section. For this purpose, this concave side is provided with two substantially longitudinally extending flanges 41*a*, 41*b* defining therebetween a groove corresponding in shape to the rib 40*a* so that the rib 40*a* may be engaged therein by slide insertion. This holding element 41 is provided at one of its ends with a cap portion 41*c* and comprises along its side edges flanges 41*e*, 41*f* whose concave sides are provided with respective longitudinal ribs 41*g*, 41*h*. The holding element 41 comprises at its end opposite from cap 41*c*, a projection 41*d* engaging in a recess 38*a* of a corresponding shape in the handle 38.

When this embodiment is assembled, the base plate 29 is, by bending its side strips 32*a*, 32*b*, made to assume the required shape so that the corresponding side ribs 34*a*, 34*b* may be kept in contact with the edge regions of the concave side of support element 39, whereupon the holding element 41 is engaged so that its internal ribs 41*g*, 41*h* cooperate with the side edges of the support element 39 so as to hold the side ribs 34*a*, 34*b* of the base plate 29 with a given clearance within the recesses bounded by the slidable holding element 41 and the contoured support element 39. One thus obtains a so-called "quarter round" brush. On completion of the assembly operation, the engagement of the projection 41*d* provided on the slidable holding element 41 within the recess 38*a* of the handle 38 prevents these two elements from turning with respect to each other.

In these last two embodiments of the brush in accordance with the invention, the scope for bending deformation and transverse displacement of the retaining ribs of the base plate 29 allows the base plate a suppleness of movement which is reflected in a higher quality brushing action.

The carbon constituent of the plastic material to give it its antistatic properties may comprise carbon fibres or a powdered "carbon gasification" product of the type disclosed in said French Patent Publication No. 2,460,198. The preparation of such a carbon product, formed by incomplete combustion of heavy hydrocarbons to prepare a gaseous mixture containing carbon monoxide and hydrogen is described in U.S. Pat. No. 2,914,418, British Pat. Nos. 734,475 and 780,120, at page 227 of "1967 Petrochemical Handbook" (Published November 1967), and at pages 118–1122 of "Industrial and Engineering Chemistry", Volume 8 No. 7.

It shall be duly understood that the embodiments described above are in no way restrictive and may give rise to any desirable modifications without thereby departing from the scope of the invention as defined by the following claims.

I claim:

1. In an antistatic hair brush comprising handle means and brushing means carried by said handle means, said brushing means embodying a flexible base means and bristles on said base means, the improvement wherein said base means is made of an antistatic plastic material and includes grid means defining apertures and bristles being integrally moulded together with said grid means and disposed perpendicular to the grid means.

2. An antistatic hair brush according to claim 1, wherein said grid means is constituted by a central oval-shaped support element, an outer oval-shaped peripheral edge member, oval-shaped further support elements between said central oval-shaped support element and said outer oval-shaped peripheral edge member, and a plurality of diverging radial ribs, most of said ribs being supported by both said central oval-shaped support element and said outer oval-shaped peripheral edge member, said ribs being arranged in intersecting relationship with said further oval-shaped support elements which are coplanar with said ribs, said further oval-shaped support elements being regularly interspaced from each other and disposed substantially concentrically with respect to each other and in relation to the central oval-shaped support element and to the outer peripheral edge member of said grid means.

3. An antistatic hair brush according to claim 2, wherein each said bristle is situated between the intersections of two adjacent said radial ribs with a said further oval-shaped element.

4. An antistatic hair brush according to claim 3, wherein each said bristle is equidistant from the intersections of two adjacent said ribs with a said further oval-shaped support element.

5. An antistatic hair brush according to claim 1, wherein said grid means is constituted by ribs intersecting at right angles so as to define between two adjacent ribs zones of the grid means over which zones the bristles are distributed in a regular manner.

6. An antistatic hair brush according to claim 5, wherein each bristle is between and equidistant from the intersections of two adjacent said ribs with a third said rib.

7. An antistatic hair brush according to claim 1, wherein the base plate is made of one of the group consisting of nylon 12, nylon 11 and nylon 11 grafted to a block copolymer of polyether and polyamide.

8. An antistatic hair brush according to claim 1, wherein said antistatic plastic material of the base means and the bristles comprises a plastic material containing at least one antistatic carbon constituent.

9. An antistatic hair brush according to claim 1, wherein said handle means and said base plate of the brushing means are integrally moulded.

10. An antistatic hair brush according to claim 1, wherein said base means of the brushing means is distinct from the handle means, and said base means is moulded flat.

11. An antistatic hair brush according to claim 10, wherein said handle means includes means defining an opening and, on the internal lateral periphery of said opening, a peripheral groove having a dovetail cross section for receiving said base means by catch-engagement, whereupon said base means assumes a shape which is convex on the side whereon the bristles are distributed.

12. An antistatic hair brush according to claim 10, wherein said handle means comprises means defining a recess having a floor, means defining a plurality of apertures in said floor, and means defining a groove of dovetail cross section on the side surface of the recess, and wherein said base means has an edge adapted to be catch engaged in said groove when said base means assumes a shape which is convex on its side whereon said bristles are distributed.

13. An antistatic hair brush according to claim 1, wherein the base means has a rectangular shape and is rolled up cylindrically and welded on two of its opposite edges to form a cylindrical base element.

14. An antistatic hair brush according to claim 13, and including a cylindrical support on which said cylindrical base element is fitted.

15. An antistatic hair brush according to claim 13, wherein said handle means includes a hand grip and a cap spaced from said hand grip, and wherein said cylindrical base element is fixed on said handle means by being held between said hand grip and said cap, and wherein said hand grip and said cap constitute two elements of the same supporting handle and are being disposed near the respective ends of said cylindrical base element.

16. An antistatic hair brush according to claim 15, wherein said handle means includes first and second ends, a rod extending axially from said first end, and a catch engagement stud adapted to cooperate with said cap to hold said cap on said rod.

17. An antistatic hair brush according to claim 1, wherein said base means comprises a rectangular plate having two opposite edges and, along each of said two opposite edges, a fastening means constituted by a strip and means flexibly connecting said strip to the respective said opposite edge of said base means, each said strip having a longitudinal rib on its free edge.

18. An antistatic hair brush according to claim 17, wherein said handle means includes a contoured extension means having a substantially crescent-shaped cross-section and including an axially extending groove means, and separate holding means comprising an axially extending flange adapted to be engaged in said groove means, wherein said holding means has a substantially T-shaped cross section, the top part of the T constituting a cap which surmounts said contoured extension means, and wherein said holding means and the contoured extension means define between them recess means wherein said longitudinal ribs of said base means strip are held.

19. An antistatic hair brush according to claim 17, wherein said handle means includes contoured extension means of crescent-shaped cross-section, an axial flange centrally of said extension means, spaced parallel groove means of said contoured extension means, and a rib at the edge of said flange, wherein said flange is disposed between said spaced groove means of the contoured extension means, and wherein said handle means further includes holding means slidable along said contoured extension means, said holding means having two longitudinal flanges adapted to receive therebetween said flange of the contoured extension and adapted to engage said spaced groove means of the contoured extension means so as to be capable of sliding engagement therealong, said holding means further comprising two side strips adapted to cooperate with said contoured extension means to hold said base means by the said longitudinal ribs of its strips.

20. An antistatic hair brush according to claim 18, wherein said handle has a hand grip at the end opposite said contoured extension means, wherein said holding means has a projection at its end near said hand grip, and wherein said hand grip includes recess means to receive said projection.

* * * * *